US007675241B2

(12) United States Patent
Lin et al.

(10) Patent No.: US 7,675,241 B2
(45) Date of Patent: Mar. 9, 2010

(54) LIGHTING APPARATUS FORMED BY SERIALLY-DRIVEN LIGHTING UNITS

(75) Inventors: Shian-Nan Lin, Hsin-Chu (TW); Yi-Hsun Lin, Hsin-Chu (TW); Cheng-Chia Hsu, Nan-Tou (TW); Deng-Kang Chang, Hsin-Chu (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 1452 days.

(21) Appl. No.: 11/038,565

(22) Filed: Jan. 18, 2005
(Under 37 CFR 1.47)

(65) Prior Publication Data

US 2005/0156542 A1 Jul. 21, 2005

(30) Foreign Application Priority Data

Jan. 15, 2004 (TW) ..... 93101003 A

(51) Int. Cl.
*H05B 37/00* (2006.01)

(52) U.S. Cl. ..... 315/224; 315/276; 315/277; 315/279; 315/307

(58) Field of Classification Search ..... 315/224, 315/307, DIG. 5, 219, 276, 277, 279
See application file for complete search history.

(56) References Cited

U.S. PATENT DOCUMENTS

| | | | | |
|---|---|---|---|---|
| 5,548,189 | A | 8/1996 | Williams | |
| 5,751,566 | A | 5/1998 | Vongehr | |
| 6,127,785 | A | 10/2000 | Williams | |
| 7,294,971 | B2 * | 11/2007 | Jin | 315/177 |

FOREIGN PATENT DOCUMENTS

| | | |
|---|---|---|
| JP | 10-092589 | 4/1998 |
| JP | 2002-231474 | 8/2002 |
| KR | 1020050054242 | 6/2005 |

* cited by examiner

*Primary Examiner*—David Hung Vu
(74) *Attorney, Agent, or Firm*—Wei Te Chung

(57) ABSTRACT

A lighting apparatus includes a lighting module, a feedback control circuit, and a DC-to-AC circuit. The lighting module comprises a first lighting unit, a second lighting unit, a first transformer, a second transformer and a third transformer. A first end of a first port of the first transformer is connected to a first end of the first lighting unit, a first end of a first port of the second transformer is connected to a second end of the first lighting unit, a second end of the first port of the second transformer is connected to a first end of the second lighting unit, and a first end of a first port of the third transformer is connected to a second end of the second lighting unit. The lighting apparatus uses serial connection of the lighting units to reduce the number of transformers and still have the feedback control circuit.

8 Claims, 5 Drawing Sheets

LIGHTING APPARATUS FORMED BY SERIALLY-DRIVEN LIGHTING UNITS

BACKGROUND OF THE INVENTION

1. Field of the Invention

The present invention relates to a lighting apparatus such as that used in an LCD (Liquid Crystal Display), and more particularly to a lighting apparatus comprising serially-driven lighting units.

2. Prior Art of the Invention

The improved quality and reduced costs of modern LCDs are making the LCD an increasingly popular choice in the field of display devices. LCDs are traditionally employed in notebook computers and other portable computer systems. LCD devices have made great progress in conjunction with the evolution of computer displays from the conventional VGA (Video Graphics Array) standard to the newer XGA (Extended Graphics Array) standard. Nowadays, LCD devices have a superior display quality to that of CRTs (Cathode Ray Tubes), and are poised to replace conventional CRT devices.

The LCD cannot achieve light-emission independently; it generally has to rely on a backlight source. The backlight source and related elements are indispensable in a typical direct-viewing type of LCD device. The performance of the backlight source significantly influences the display quality of the LCD device. Moreover, the backlight source is a large contributor to the cost and power consumption of the LCD device.

A typical backlight source of an LCD is implemented by utilizing several lamps. Apparatuses and means for driving these lamps are important technologies. FIG. 4 illustrates a prior art lighting apparatus 8, which includes N lamps 10 and 2N transformers 12, 14. The 2N transformers 12, 14 are connected to the N lamps 10 so that both ends of each lamp 10 are respectively connected to two corresponding of the transformers 12, 14. Taking the initial lamp 10 as an example, one end of the lamp 10 is connected to the initial transformer 12, while the other end of the lamp 10 is connected to a second transformer 14. Generally speaking, the lamp 10 is driven by a high voltage, and this high voltage is even higher than the voltage of the power supply. Therefore, when the voltage of the power supply is applied to the lamp 10, the voltage has to be boosted to a higher level. The transformers 12, 14 connected to both ends of the lamp 10 are used to boost the voltage. Because each lamp 10 needs two transformers 12, 14, the N lamps 10 need the 2N transformers 12, 14.

The lighting apparatus 8 commonly employs numerous lamps 10 in order to illuminate a large LCD, thus requiring a large number of transformers 12, 14 to be used in the system. Backlight modules for this kind of display system are unduly large, and result in increased production costs.

FIG. 5 illustrates another prior art lighting apparatus 18. The lighting apparatus 18 includes N lamps 20 and N transformers 22. As shown, each lamp 20 is controlled by an individual transformer 22. A positive high-voltage end and a negative high-voltage end of the lamp 20 are connected to the transformer 22, so that the boosted high voltage provided by the transformer 22 is applied to the lamp 20. The N lamps 20 only need N transformers 22, which significantly reduces the above-described disadvantages of the lighting apparatus 8.

In the lighting apparatus 18, a feedback control circuit to control the current of the N lamps 20 should be employed, so that the lighting apparatus 18 is more stable. A feedback control mechanism achieves two main purposes. Firstly, the brightness of each lamp 20 needs to be adjusted by adjusting the current of the lamp 20. The feedback control mechanism can finely increase or decrease the current of the lamp 20 according to feedback signals in order that the lamp 20 has a proper level of brightness. Secondly, the feedback control mechanism makes the current stable. If distortions in the current occur without any feedback, the brightness of the lamp 20 becomes unstable. However, in the lighting apparatus 18, both high voltage ports of the corresponding transformer 22 are connected to the single lamp 20, which means that the lighting apparatus 18 cannot be provided with the feedback control mechanism directly. Therefore, in practice, the lighting apparatus 18 is not provided with a feedback control mechanism, and does not have the advantages of being able to make the lighting system stable and being able to accurately adjust the brightness of the lamps 20. This is contrast with the lighting apparatus 8, in which the transformers 12, 14 each have one high voltage port connected to ground. That is, the lighting apparatus 8 can be provided with a feedback control mechanism directly.

In summary, in the lighting apparatus 8, the numerous transformers 12, 14 increase overall size and production costs. In the lighting apparatus 18, a feedback control mechanism cannot be provided, which makes it difficult to control the lamps 20. With ongoing improvements in LCD technologies, there is increasing demand to enhance both the cost-effectiveness and the quality of LCDs. However, conventional lighting apparatuses are unable to adequately meet this demand.

SUMMARY OF THE INVENTION

It is therefore an object of the present invention to provide a lighting apparatus for driving discharge lamps which readily enables deployment of a feedback control mechanism and which is cost-effective.

According to a first embodiment of the present invention, a lighting apparatus formed by a plurality of serially-driven lighting units comprises a lighting module. The lighting module comprises a first lighting unit, a second lighting unit, a first transformer, a second transformer and a third transformer. A first end of a first port of the first transformer is connected to a first end of the first lighting unit, a first end of a first port of the second transformer is connected to a second end of the first lighting unit, a second end of the first port of the second transformer is connected to a first end of the second lighting unit, and a first end of a first port of the third transformer is connected to a second end of the second lighting unit. Both a second end of the first port of the first transformer and a second end of the first port of the third transformer are connected to ground. Thus, the first transformer or the third transformer can be attached to a feedback control circuit.

In a second embodiment of the present invention, a current balance control circuit is disposed between the second end of the first lighting unit and the first end of the second lighting unit. The first end of the first port of the second transformer is connected to the current balance control circuit, and the second end of the first port of the second transformer is connected to ground. In this manner, each of the transformers can help implement feedback control.

Unlike in the prior art, the lighting apparatus of the present invention uses serial connection of the lighting units to reduce the number of transformers and still be able to apply the feedback control circuit or the current balance control circuits. Therefore, the amount of hardware elements of the lighting apparatus of the present invention is less than that of the prior art, and the size of an associated LCD is correspondingly reduced. The lighting apparatus of the present invention has advantages of compactness, low cass and high quality not provided by the prior art.

These and other objectives of the present invention will become apparent to those of ordinary skill in the art after reading the following detailed description of the preferred embodiments that are illustrated in the various figures and drawings.

DETAILED DESCRIPTION OF THE INVENTION

Figure 1:
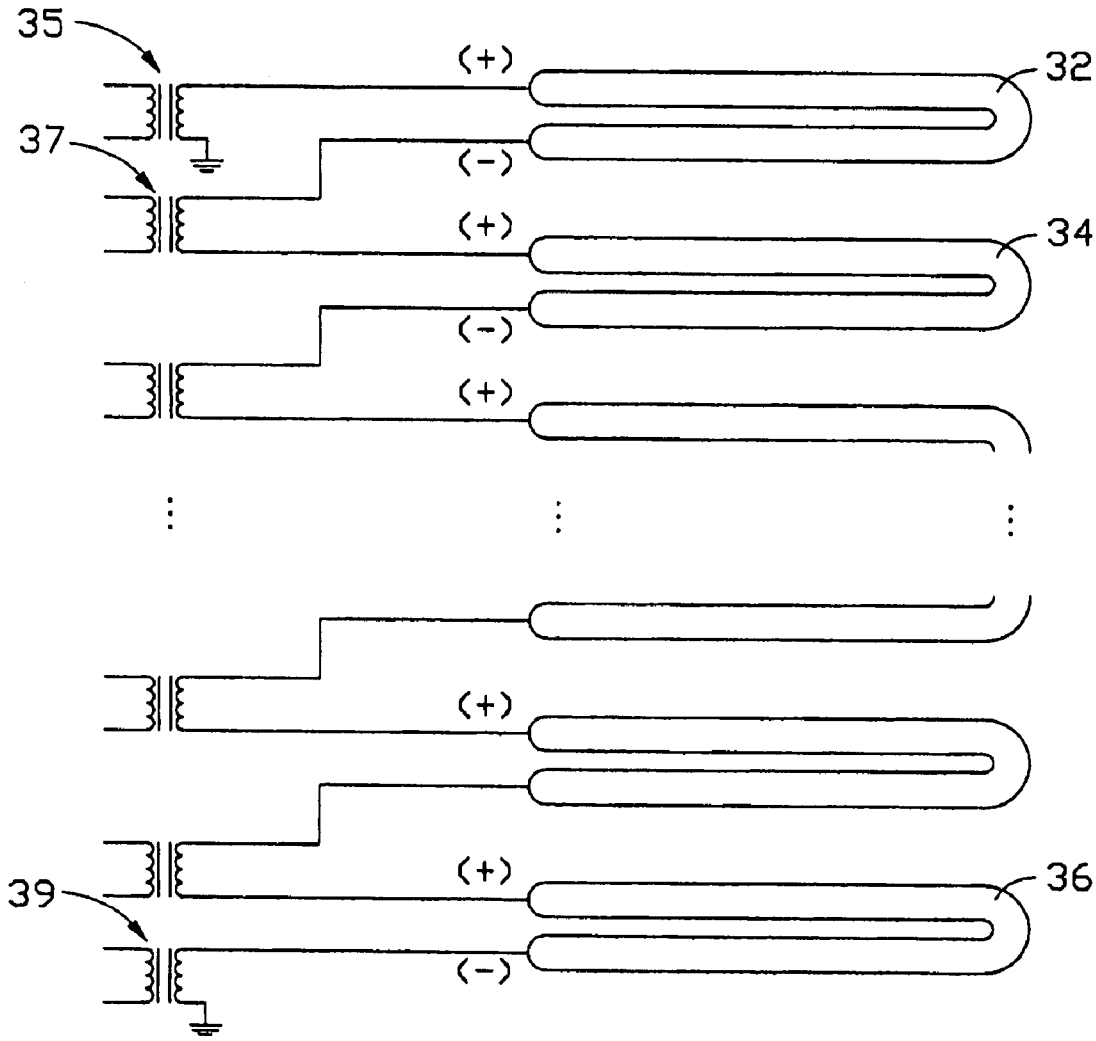
FIG. 1 schematically illustrates part of a lighting apparatus according to the first embodiment of the present invention.

FIG. 1 illustrates a part of a lighting apparatus according to the first embodiment of the present invention. Said part of the lighting apparatus comprises N lighting units 32, 34, . . . , 36, as well as N+1 transformers 35, 37, . . . , 39 (N being an integer greater than 1). Each of the transformers 35, 37, . . . , 39 has two ports: one input port and one output port. Each port has two ends to input or output voltage signals. When the input port receives low voltage AC power, the output port will transform the received low voltage AC power into high voltage AC power. The lighting units 32, 34, . . . , 36 of the present invention can be implemented by various lighting elements, such as discharge lamps. The N lighting units 32, 34, . . . , 36 are serially connected by the N+1 transformers 35, 37, . . . , 39 so that a positive high-voltage end and a negative high-voltage end of each lighting unit 32, 34, . . . , 36 are respectively connected to the transformers 35, 37, . . . , 39. Each two contiguous of the lighting units 32, 34, . . . , 36 share one corresponding of the transformer 35, 37, . . . , 39. For example, the positive high-voltage end of the initial lighting unit 32 is connected to the initial transformer 35, and the negative high-voltage end of the lighting unit 32 is connected to the transformer 37. In particular, the negative high-voltage end of the lighting unit 32 is connected to one end of the high voltage port of the transformer 37, and the positive high-voltage end of the lighting unit 34 is connected to the other end of the high voltage port of the transformer 37. In other words, the lighting unit 32 and the lighting unit 34 share the transformer 37 and are serially connected by the transformer 37.

As described above, one end of the high voltage port of the transformer 35 is connected to the positive high-voltage end of the lighting unit 32. Further, the other end of the high voltage port of the transformer 35 is connected to ground. Similarly, one end of the high voltage port of the terminal transformer 39 is connected to the negative high-voltage end of the lighting unit 36, while the other end of the high voltage port of the transformer 39 is connected to ground. In the first embodiment, one end of the high voltage port of the transformer 35 and one end of the high voltage port of the transformer 39 are each connected to ground. Thus, the transformer 35 or the transformer 39 can be attached to a feedback control circuit. In other words, the current passing through the lighting units 32, 36 can be sampled by a feedback means, for execution of feedback control of the lighting units 32, 34, . . . , 36.

In said part of the lighting apparatus comprising N lighting units 32, 34, . . . , 36, only N+1 transformers 35, 37, . . . , 39 are needed to drive the lighting units 32, 34, . . . , 36. Moreover, a feedback circuit can be added for accurate and stable feedback control of said part of the lighting apparatus. The present invention achieves the dual advantages of low cost and high quality. Details of the feedback system are described below in relation to FIG. 2.

Figure 2:
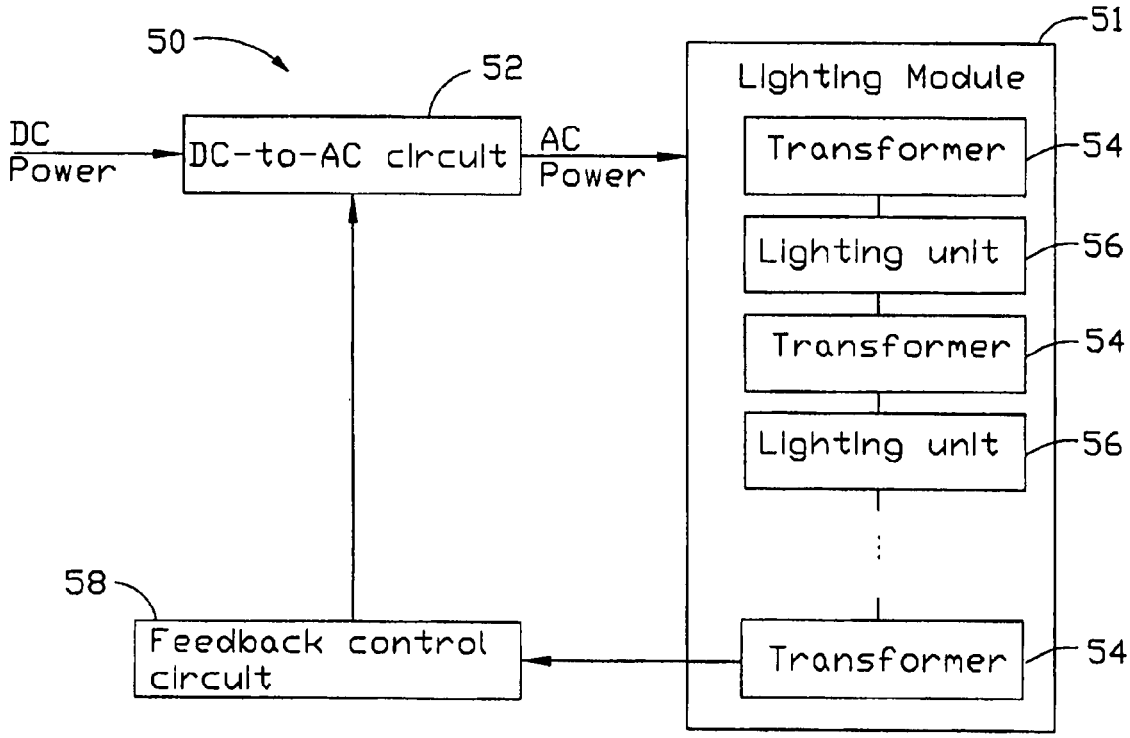
FIG. 2 is a block diagram of the lighting apparatus according to the first embodiment of the present invention.

Referring to FIG. 2, this illustrates a lighting apparatus 50 according to the first embodiment of the present invention. The lighting apparatus 50 comprises a DC-to-AC circuit 52, a feedback control circuit 58, and a lighting module 51. The lighting module 51 comprises transformers 54 and lighting units 56. The DC-to-AC circuit 52 transforms input DC power into AC power. The DC-AC transformation carried out by the DC-to-AC circuit 52 can be performed by way of, for example, a current being conducted when a switch is ON, with a high voltage being output. When the switch is OFF, no current is conducted, and a low voltage is output. Thus, the DC power passed to the switch that periodically turns on and off is transformed into periodic pulses. The periodic pulses are the output AC power of the DC-to-AC circuit 52. The method of transforming DC power into AC power is a well-known technique involving pulse width modulation (PWM). The output AC power of the DC-to-AC circuit 52 is input to the transformers 54 of the lighting module 51, and is provided to the lighting units 56 after being boosted by the transformers 54. The connection of the transformers 54 and the lighting units 56 is similar to the connection of the transformers 35, 37, . . . , 39 and the lighting units 32, 34, . . . , 36 described above in relation to FIG. 1. To implement the feedback control, the current of the lighting units 56 is sampled by the feedback control circuit 58. The feedback control circuit 58 is connected to the terminal transformer 54. The feedback control circuit 58 receives the current signal of the lighting units 56 through the terminal transformer 54, and outputs a control signal that is sent to the DC-to-AC circuit 52. The DC-to-AC circuit 52 changes the characteristics of the output AC power according to the control signal. Here, the characteristics of the output AC power include the period of oscillation, the magnitude of the pulses, etc. The input AC power boosted by each transformer 54 affects the brightness of a corresponding lighting unit 56. Therefore, if the brightness of any one of the lighting units 56 has to be changed, the current flowing through the lighting units 56 is adjusted accordingly. The DC-to-AC circuit 52, the lighting module 51, and the feedback control circuit 58 form a feedback loop, for controlling the brightness of the lighting units 56 by detecting and adjusting the current flowing through the lighting units 56.

Figure 3:
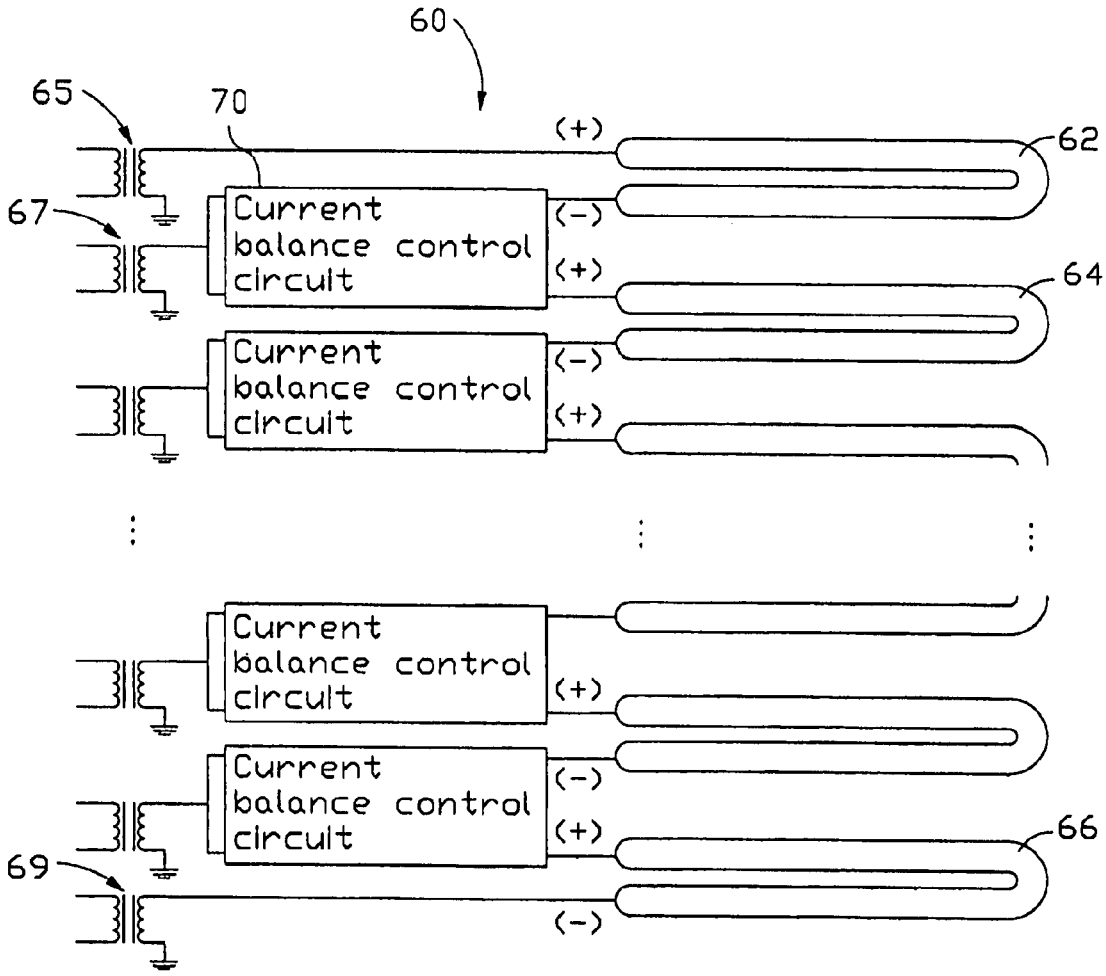
FIG. 3 schematically illustrates a lighting apparatus according to the second embodiment of the present invention.
Figure 4:
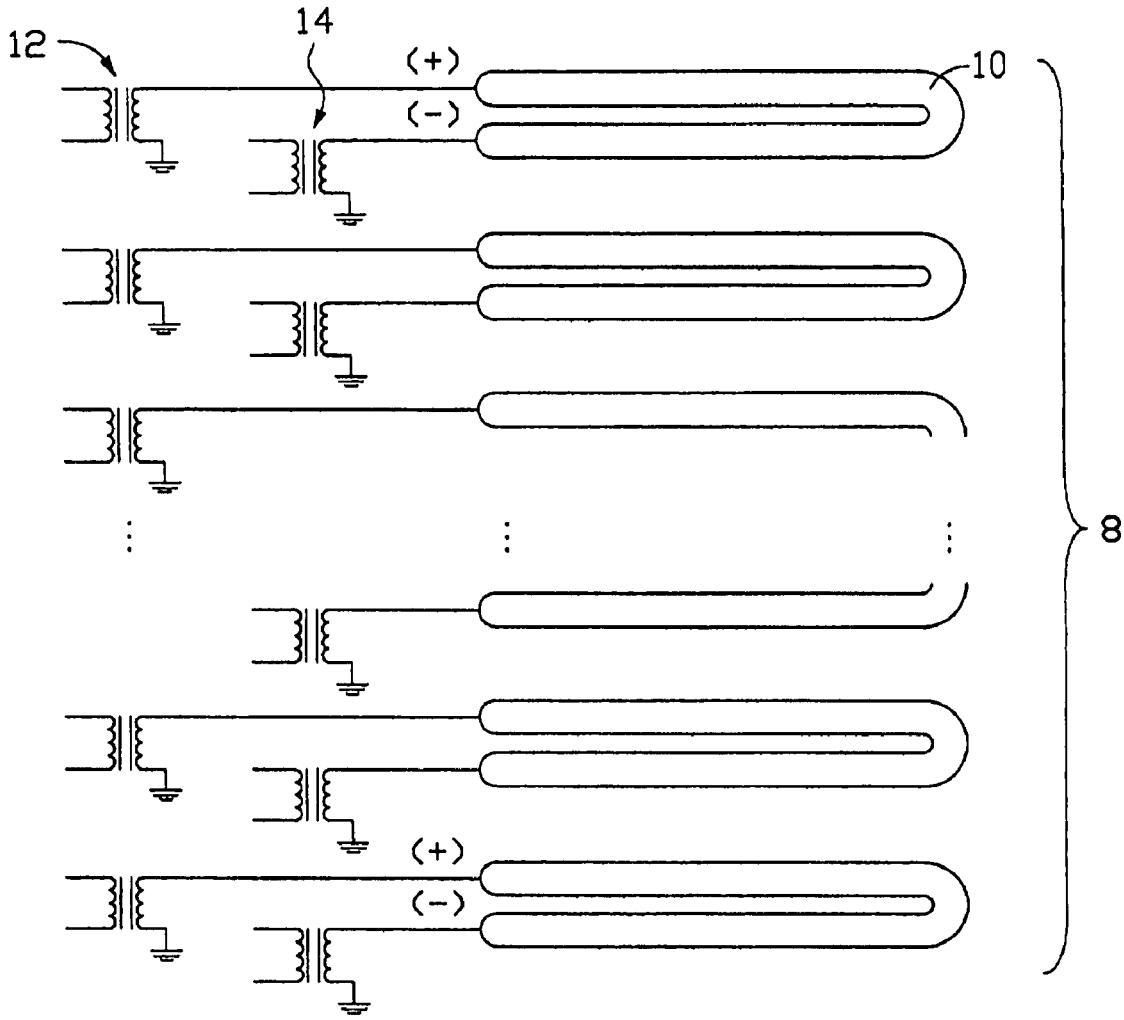
FIG. 4 (PRIOR ART)
FIG. 4 schematically illustrates a prior art lighting apparatus.
Figure 5:
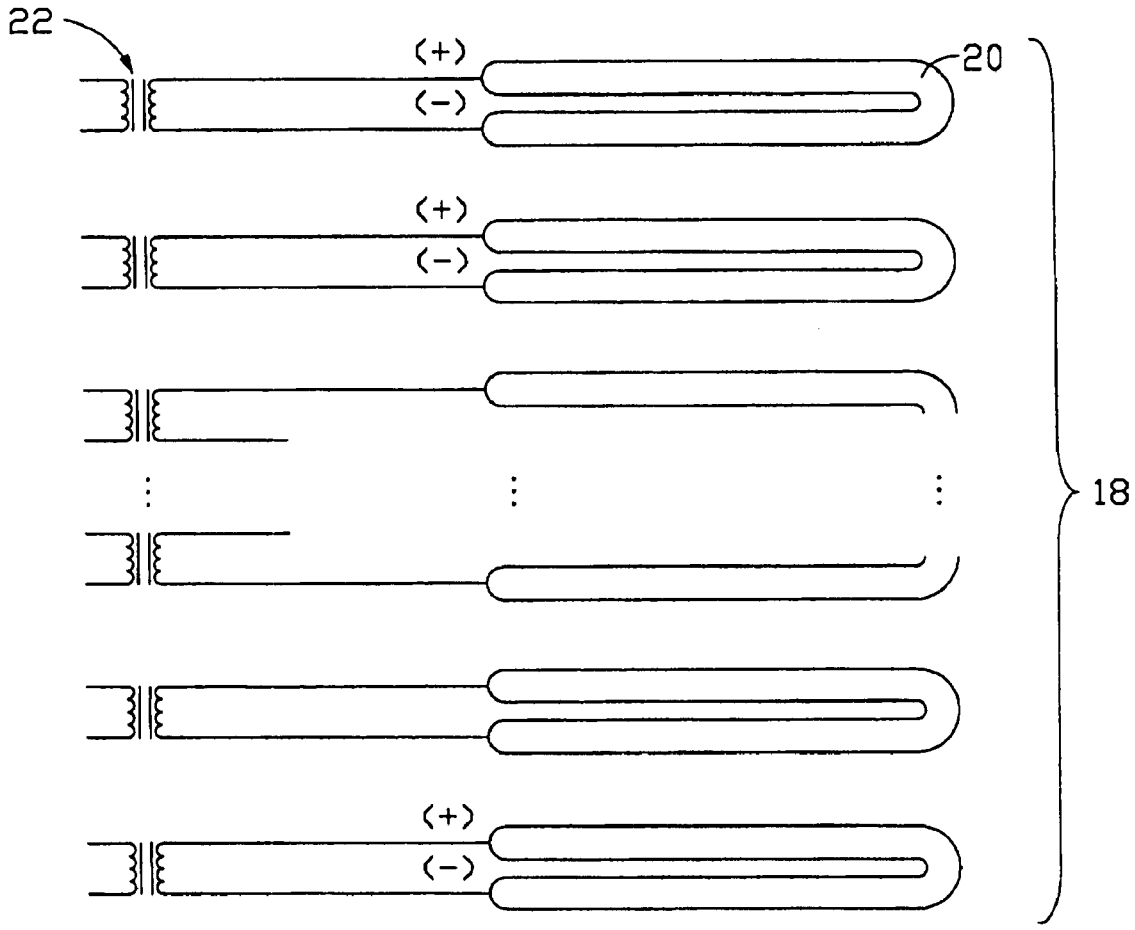
FIG. 5 (PRIOR ART)
FIG. 5 schematically illustrates another prior art lighting apparatus.

FIG. 3 illustrates a lighting apparatus 60 according to the second embodiment of the present invention. The lighting apparatus 60 comprises N lighting units 62, 64, . . . , 66, N−1 current balance control circuits 70, and N+1 transformers 65, 67, . . . , 69 (N being an integer greater than 1). All the transformers 65, 67, . . . , 69 and lighting units 62, 64, . . . , 66 are similar to the transformers 35, 37, . . . , 39 and lighting units 32, 34, . . . , 36 described above in relation to FIG. 1, except that the transformers 65, 67, . . . , 69 are allocated differently. The N lighting units 62, 64, . . . , 66 are serially connected by the N−1 current balance control circuits 70, so that each of the N−1 current balance control circuits 70 has a connection with two corresponding of the lighting units 62, 64, . . . , 66. In addition, each current balance control circuit 70 is connected to a corresponding one of the transformers 65, 67, . . . , 69. For example, the negative high-voltage end of the initial lighting unit 62 and the positive high-voltage end of the lighting unit 64 are connected to the initial current balance control circuit 70. Further, the initial current balance control circuit 70 is also connected to one end of the high voltage port of the transformer 67. The other end of the high voltage port of the transformer 67 is connected to ground. The initial current balance control circuit 70 is used to balance the current flowing through the lighting units 62, 64 that are connected thereto. In the normal case, the current flowing through the serially-connected lighting units 62, 64 should be balanced. However, in practice, certain variables can cause the current to be different in the lighting units 62, 64, resulting in different brightnesses thereof. Therefore, the initial current balance control circuit 70 balances the current flowing through the lighting units 62, 64.

Further, one end of the high voltage port of the initial transformer 65 is connected to the positive high-voltage end of the lighting unit 62, and the other end of the high voltage port of the transformer 65 is connected to ground. Similarly, one end of the high voltage port of the terminal transformer 69 is connected to the negative high-voltage end of the terminal lighting unit 66, and the other end of the high voltage port of the transformer 69 is connected to ground. In the lighting apparatus 60, one end of the high voltage port of each of the transformers 65, 67, . . . , 69 is connected to ground. Therefore, each of the transformers 65, 67, . . . , 69 can help implement feedback control. The feedback control circuit of the lighting apparatus 60 detects the current of each transformer 65, 67, . . . , 69 (the current of each transformer 65, 67, . . . , 69 has a fixed ratio in relation to the current of each lamp 62, 64, . . . , 66) and outputs a corresponding feedback control signal. Thus in the lighting apparatus 60 with N lighting units 62, 64, . . . , 66, only N+1 transformers 65, 67, . . . , 69 are needed to implement the control of the lighting units 62, 64, . . . , 66, and each of the transformers 65, 67, . . . , 69 can be included in the feedback system.

Unlike in the prior art, the lighting apparatus of the present invention uses serial connection of the lighting units to reduce the number of transformers and still be able to apply a feedback control circuit. Therefore, the amount of hardware elements of the lighting apparatus of the present invention is less than that of the prior art, and the size of an associated LCD is correspondingly reduced. As described above in relation to the second embodiment of the present invention, the current flowing in the N lamps and the brightnesses of the N lamps can be balanced by the N−1 corresponding current balance control circuits. The lighting apparatus of the present invention has advantages of compactness, low cost and high quality not provided by the prior art.

Those skilled in the art will readily observe that numerous modifications and alterations of the described devices may be made while retaining the teachings of the invention. Accordingly, the above disclosure should be construed as merely being exemplary of the present invention as delineated by the appended claims and allowable equivalents thereof.

What is claimed is:

1. A lighting apparatus formed by a plurality of serially-driven lighting units, comprising:

a lighting module, comprising:

at least two lighting units, and at least three transformers, wherein a first end of a first port of one transformer of said at least three transformers is connected to a first end of one lighting unit of said at least two lighting units, a first end of a first port of another transformer of said at least three transformers is connected to a second end of said one lighting unit of said at least two lighting units, a second end of the first port of said another transformer of said at least three transformers is connected to a first end of another lighting unit of said at least two lighting units, and a first end of a first port of a terminal transformer of said at least three transformers is connected to a second end of said another lighting unit of said at least two lighting units; and a feedback control circuit connected to a second end of the first port of said terminal transformer of said at least three transformers that is connected to a terminal lighting unit of said at least two lighting units, so as to output a control signal according to the current flowing through said terminal lighting unit of said at least two lighting units.

2. The lighting apparatus in claim 1, wherein a second end of a first port of an initial transformer of said at least three transformers is connected to ground.

3. The lighting apparatus in claim 1, wherein a second end of the first port of said terminal transformer of said at least three transformers is connected to ground.

4. The lighting apparatus in claim 1, further comprising a DC-to-AC circuit connected to the lighting module and the feedback control circuit, for transforming DC power into AC power and for adjusting the AC power according to the control signal outputted by the feedback control circuit.

5. The lighting apparatus in claim 1, wherein each lighting unit of said at least two lighting units is a discharge lamp.

6. A lighting apparatus formed by a plurality of serially-driven lighting units, comprising:

a lighting module, comprising:

at least two lighting units, and at least three transformers, wherein a first end of one lighting unit of said at least two lighting units is connected to a first end of a first port of a first transformer of said at least three transformers, a second end of said one lighting unit of said at least two lighting units is connected to a first end of a first port of an intermediate transformer of said at least three transformers, a first end of another lighting unit of said at least two lighting units is connected to said first port of said intermediate transformer of said at least three transformers, and a second end of said another lighting unit of said at least two lighting units is connected to a first end of a first port of a terminal transformer of said at least three transformers, said first end of said another lighting unit of said at least two lighting units is connected to a second end of said first port of said intermediate transformer of said at least three transformers; and a feedback control circuit connected to a second end of said first port of said terminal transformer of said at least three transformers that is connected to a terminal lighting unit of said at least two lighting units, so as to output a control signal according to the current flowing through said terminal lighting unit of said at least two lighting units.

7. The lighting apparatus in claim 6, wherein a second end of said first port of said terminal transformer of said at least three transformers is connected to ground.

8. The lighting apparatus in claim 6, wherein a second end of said first port of said first transformer of said at least three transformers is connected to ground.

* * * * *